US009862582B2

(12) United States Patent
Cummings et al.

(10) Patent No.: US 9,862,582 B2
(45) **Date of Patent: *Jan. 9, 2018**

(54) AERIAL LIFT WITH SAFETY DEVICE AND ALARM

(71) Applicant: BLUESKY SOLUTIONS LIMITED, Lutterworth, Leicestershire (GB)

(72) Inventors: Paul Cummings, Bicester (GB); Kevin Gale, Marlow (GB)

(73) Assignee: BLUESKY SOLUTIONS LIMITED, Lutterworth, Leicestershire (GB)

( * ) Notice: Subject to any disclaimer, the term of this patent is extended or adjusted under 35 U.S.C. 154(b) by 8 days.

This patent is subject to a terminal disclaimer.

(21) Appl. No.: 14/367,330

(22) PCT Filed: Dec. 18, 2012

(86) PCT No.: PCT/GB2012/000912

§ 371 (c)(1),
(2) Date: Jun. 20, 2014

(87) PCT Pub. No.: WO2013/093395

PCT Pub. Date: Jun. 27, 2013

(65) Prior Publication Data

US 2015/0008073 A1 Jan. 8, 2015

(30) Foreign Application Priority Data

Dec. 21, 2011 (GB) ..... 1122104.1

(51) Int. Cl.
*B66F 17/00* (2006.01)
*B66F 11/04* (2006.01)
(Continued)

(52) U.S. Cl.
CPC ..... *B66F 17/006* (2013.01); *B66F 11/04* (2013.01); *B66F 11/044* (2013.01); *B66C 15/06* (2013.01); *B66F 9/24* (2013.01)

(58) Field of Classification Search
CPC ..... B66F 11/04; B66F 11/044; B66F 11/046; B66F 17/006; B66F 9/24; B66C 15/06
See application file for complete search history.

(56) References Cited

U.S. PATENT DOCUMENTS 4,456,093 A * 6/1984 Finley ..... B66F 17/006 182/18
4,979,586 A * 12/1990 Lazzeroni ..... A42B 3/166 181/129
(Continued)

FOREIGN PATENT DOCUMENTS

EP 2 096 078 B1 9/2009
EP 2 281 772 A2 2/2011
(Continued)

OTHER PUBLICATIONS

Search report from British Patent Application No. GB1122104.1, dated Apr. 19, 2012, 1 page.
(Continued)

*Primary Examiner* — Daniel P Cahn
(74) *Attorney, Agent, or Firm* — Foley & Lardner LLP

(57) ABSTRACT

A safety device for an aerial lift includes a basket with controls which permit an operator standing in the basket to maneuver the basket. The safety device includes an alarm, a switch activation device proximate to the controls and two solenoid operated relays, one connected with a normally-closed manually operable emergency switch which is operable to cut electrical supply and prevent further movement of the basket, and one connected with a foot operable safety switch, which must be held closed by an operator to activate the controls. Each relay is held in a closed condition unless caused to change to an open condition to cut electrical supply. The relays are controlled by a programmable control box connected to the switch activation device, foot switch
(Continued)

and alarm. The control box causes the alarm to operate in accordance with the condition of the foot operable safety switch.

13 Claims, 4 Drawing Sheets

(51) Int. Cl.
*B66C 15/06* (2006.01)
*B66F 9/24* (2006.01)

(56) References Cited

U.S. PATENT DOCUMENTS 5,021,917 A * 6/1991 Pike ..... H01H 47/002 182/2.11
5,044,472 A 9/1991 Dammeyer et al.
5,121,816 A * 6/1992 Curtin ..... B66B 9/04 187/243
5,992,572 A 11/1999 Gilliland et al.
6,330,931 B1 * 12/2001 Baillargeon ..... A62B 35/0037 182/18
6,405,114 B1 * 6/2002 Priestley ..... B66F 11/046 182/18
6,595,330 B1 * 7/2003 Henrickson ..... B66F 9/0655 187/223
9,193,573 B1 * 11/2015 Troy ..... B66F 11/042
2005/0187712 A1 * 8/2005 Callaghan ..... B66B 5/0031 701/301
2007/0084450 A1 * 4/2007 Oka ..... B60K 28/08 123/675
2011/0209943 A1 * 9/2011 Bowden ..... G01G 19/083 182/18
2012/0217091 A1 * 8/2012 Baillargeon ..... G08B 21/02 182/18
2013/0233645 A1 * 9/2013 Hao ..... B66F 17/006 182/19
2013/0313040 A1 * 11/2013 Cummings ..... B66F 17/006 182/18
2014/0021912 A1 * 1/2014 Martin ..... B60L 11/1833 320/109

FOREIGN PATENT DOCUMENTS

GB 2481709 1/2012
WO WO2012/001353 A1 1/2012

OTHER PUBLICATIONS

International Search Report from PCT/GB2012/000912, dated Mar. 13, 2013, 3 pages.
Written Opinion from PCT/GB2012/000912, dated Mar. 13, 2013, 6 pages.

* cited by examiner

AERIAL LIFT WITH SAFETY DEVICE AND ALARM

CROSS-REFERENCE TO RELATED APPLICATIONS

The present application is a U.S. National Stage Application of International Application No. PCT/GB2012/000912, filed on Dec. 18, 2012, which claims priority to British Patent Application No. 1122104.1, filed Dec. 21, 2011. The contents of both applications are hereby incorporated herein by reference in their entirety.

FIELD OF THE INVENTION

The present invention relates to an aerial lift having a safety device and an alarm to alert third parties to possible problems.

BACKGROUND OF THE INVENTION

Building construction sites for large buildings frequently employ aerial lift equipment for lifting operatives to elevated locations for, for example, the installation of overhead pipe work during the construction of a building.

A typical aerial lift may comprise a mobile elevated work platform (MEWP) having an extendable boom which has an elevator basket or cage for housing operatives secured to the end of the boom. The basket or cage may contain a control panel which permits a user standing in the basket or cage to manoeuvre the basket or cage to a raised location which facilitates the carrying out of work. The boom is typically raised by a powered hydraulic system on the vehicle.

The controls in elevator baskets typically include an emergency stop and a foot operated safety switch which needs to be closed before the controls may be operated. If the foot safety switch is released the movement of the basket ceases immediately and the MEWP engine continues to run. If the emergency stop safety switch is triggered both the basket and MEWP engine are stopped. In some situations, operators can become trapped between the MEWP basket and an overhead structure before they can either remove their foot from the foot safety switch or operate the emergency stop. Operators trapped in this way can be crushed sometimes fatally.

In EP-A-2096 078, the present applicant has described a safety device comprising a tensioned wire or cord arranged proximate to the controls and an auxiliary safety switch connected in series with the foot safety switch. The operation of the auxiliary safety switch via the tensioned wire or cord stops the movement of the basket and may also operate an alarm to indicate to other parties the fact that the safety device has been operated.

The present invention provides a safety device for an overhead work platform and which has an improved alarm control system.

SUMMARY OF THE INVENTION

According to a first aspect, there is provided a safety device for an aerial lift having a basket or cage with controls which permit an operator standing in the basket or cage to manoeuvre the basket or cage, the controls including a manually operable emergency switch means which is normally closed to allow the flow of electricity and is operable to cut electrical supply and prevent further movement of the basket or cage and a foot operable safety switch which must be held closed by an operator to activate the controls, the safety device comprising an alarm, a switch activation device proximate to said controls and two solenoid operated relays, one connected with the manually operable emergency switch means and one connected with the foot operable safety switch, the solenoids holding each respective relay in a closed condition (switch on) unless caused to change to an open condition (switch off) thereby cutting off said electrical supply, the two solenoid operated relays being controlled by a programmable control box connected to the switch activation device, foot operable safety switch and alarm and wherein the control box causes the alarm to operate in accordance with the condition of the foot operable safety switch.

The switch activation device may for example comprise a tensioned wire or cord, as disclosed in EP-A-2096 078, a movable bar which operates the switch when subject to a transverse load or, preferably, a pressure sensitive safety edge, for example a Mayser IP 65. Safety edges are sensors, which may be offered as a normally open contact. If the moving part that includes the safety edge or safety bumper strikes an operator (or vice versa) the flexible safety edge is depressed under the applied load and will send a signal for a relay to open and the automatic movement is stopped. Other types of switch activation device include non-contact devices such as optical sensors activated by light beams and light curtains and devices that operate by differential capacitance.

The control box operates the alarm independently of the activation of the relays. Conveniently, the control box operates the alarm only when the foot switch is depressed by an operator and the safety edge is compromised and the alarm is not sounded when the foot switch is raised and the basket or cage is parked.

By "compromised" it is meant that a load is exerted on the safety edge sufficient to trigger the alarm.

The control box may be programmed to run a self-diagnostic test routine when the aerial lift is first switched on and the foot switch raised, to check if the safety system is correctly wired into the controls and that the safety device will not reset if compromised. The diagnostic routine may continue to operate after the start-up whilst the aerial lift is in operation.

The control box may automatically activate the safety device provided that the self-diagnostic tests show that the wiring is fine and the safety device is reset.

Where the aerial lift further includes a load sensor, the control box may monitor the output from the load sensor, and the alarm may be sounded if the load sensor indicates an overload when the foot switch is raised. The alarm may also sound if the safety edge is compromised as the foot switch is raised.

The signal to the alarm may pass through a signal filter so that the alarm is operated after a predetermined period and a further timer is located between the control box and the alarm and permits the alarm to operate intermittently for a pre-set time period.

The control box may be connected to a reset device allowing the alarm to be switched off within said pre-set time period provided that the switch activation device has ceased operation. The control box may be also connected to the alarm via a second timer which causes the alarm to operate continuously after said pre-set time period. Preferably, the control box is connected to an override switch permitting the alarm to operate continuously during the pre-set time period. The control box may be programmed to cause the alarm to sound in distinctive patterns, such as SOS in Morse code, when the basket or cage is in an elevated position and the safety device fails.

According to a second aspect, there is provided an aerial lift comprising a basket or cage having controls which permit an operator standing in the basket to manoeuvre the basket or cage, the aerial lift including a safety device according to the first aspect.

The alarm may be mounted on the underside of the basket or cage and may comprise a beacon and/or an audible warning device. The alarm may further include an RF transmitter which sends a radio signal to at least one further alarm remote from the basket or cage and which includes a co-operating receiver which operates said alarms.

The safety device and the alarm are connected to the emergency switch means and the foot switch through readily connectable and disconnectable pin and socket connectors facilitating the assembly and disassembly of the safety device from the basket or cage for testing, maintenance or replacement.

The basket or cage may be mounted at one end of an extendable boom, which is typically raised by a powered hydraulic system on the vehicle.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

There will now be described by way of example a specific mode contemplated by the inventor(s). In the following description numerous specific details are set forth in order to provide a thorough understanding. It will be apparent however, to one skilled in the art, that the present invention may be practiced without limitation to these specific details. In other instances, well known methods and structures are not described in detail so as not to unnecessarily obscure the description.

FIG. 1

Figure 1:
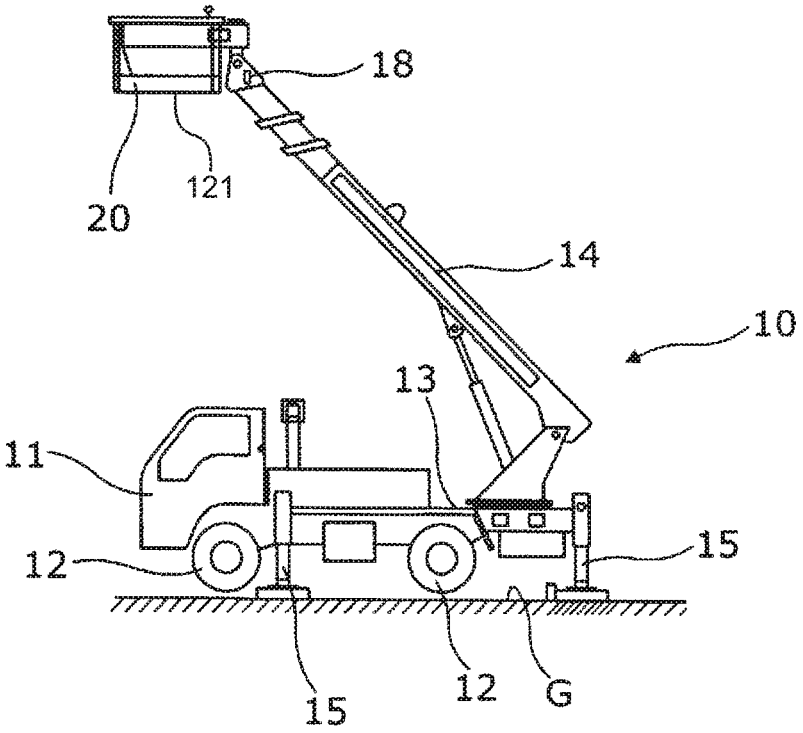
FIG. 1 shows a view of a mobile elevated work platform (MEWP) on an extendable boom.

With reference to FIG. 1, there is shown a mobile elevated work platform (MEWP) 10 in the form of a self drive mobile lift of any suitable type. The MEWP 10 has a drivable vehicle body 11 having wheels 12 and an extendable boom 14 mounted on a load carrying platform 13 at the rear of the vehicle body 11. Stabilisers 15 may be provided for steadying the vehicle on the ground G. A basket 20 or cage is mounted on the free end of the boom 14 and the basket 20, in use, can be raised or lowered and generally manoeuvred relative to the ground G as is well known. The basket 20 is shown in a raised condition. The boom 14 is raised, lowered, extended, rotated etc. by any suitable means, typically operated by a powered hydraulic system provided on the vehicle body 11 and powered by the vehicle engine. The boom 14 may be provided with a load sensor 18 which senses the total load on the boom 14.

The MEWP 10 shown in FIG. 1 is for example only and any type of aerial lift may be used; the present invention is applicable to any form of aerial lift, including scissor lifts, having an operator carrying basket, cage or platform which is provided with controls in the basket or cage that allow the operator to manoeuvre the basket or cage, and sometimes the vehicle, utilising the MEWP power systems.

FIG. 2

Figure 2:
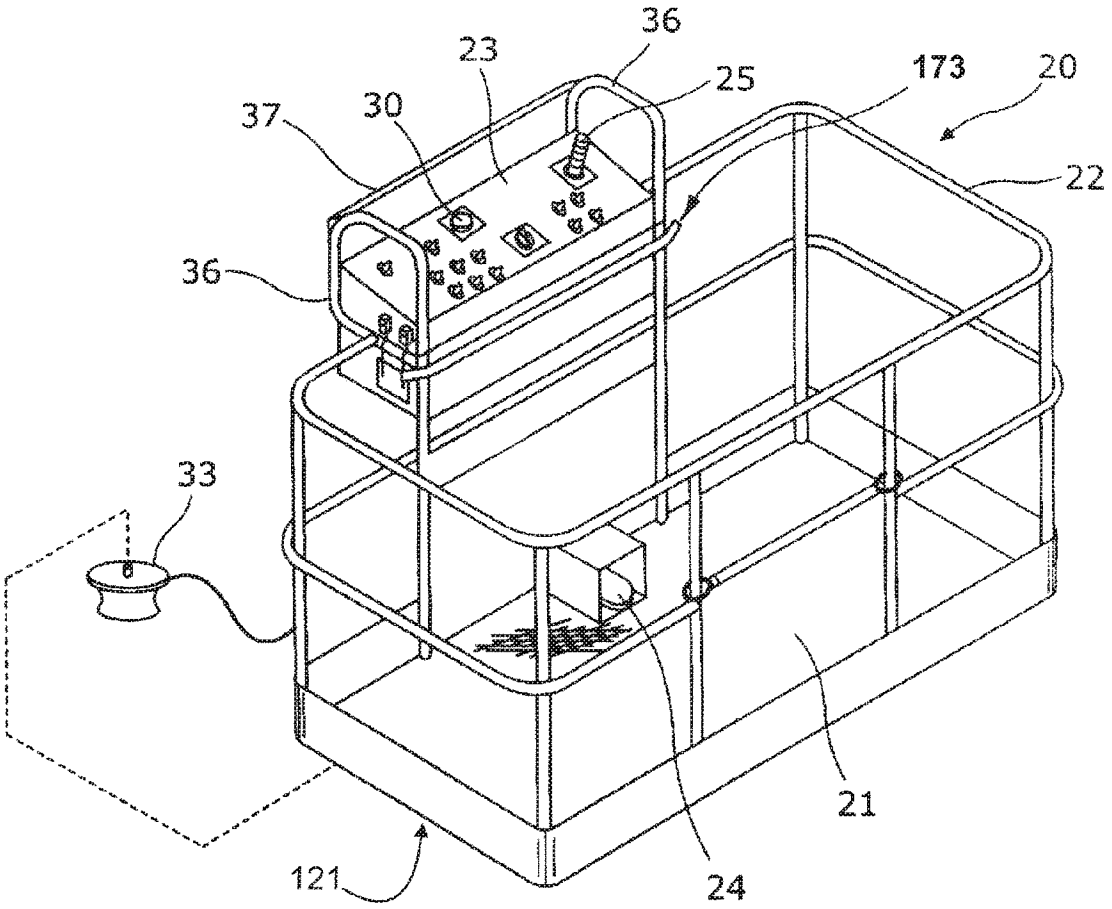
FIG. 2 shows an isometric view of a basket or cage mounted on the extendable boom shown in FIG. 1, having a safety device and a trip wire as the switch activation device.

With reference to FIG. 2, there is shown the lift or elevator basket 20 having a floor 21 surrounded by a safety barrier 22. The basket 20 is provided with controls 23 whereby an operator standing in the basket 20 can cause the basket 20 to be moved to a desired location. The controls 23, shown as a control panel, may further include a foot operable safety switch 24 which must be depressed before an operator in the basket 20 can cause the MEWP 10 to move the basket 20. In the event that the foot operable safety switch 24 is raised, any movement of the basket 20 will cease immediately with the MEWP engine continuing to run. The foot operable safety switch 24 is typically connected to a control means, usually a valve means, which shuts off the vehicle's power supply to prevent movement of the basket 20 if the foot operable safety switch 24 is not closed.

A manually operable emergency switch means, shown as an emergency stop 30, is provided on the control panel 23 which is also connected to the control means and will also shut off the power supply when activated to prevent movement of the basket and will simultaneously shut down the MEWP engine.

The general movement of the basket 20 is controlled by a control lever 25. The control panel 23 may be partially protected by protection bars 36 and a back plate 37.

FIGS. 3 & 4

Figure 3:
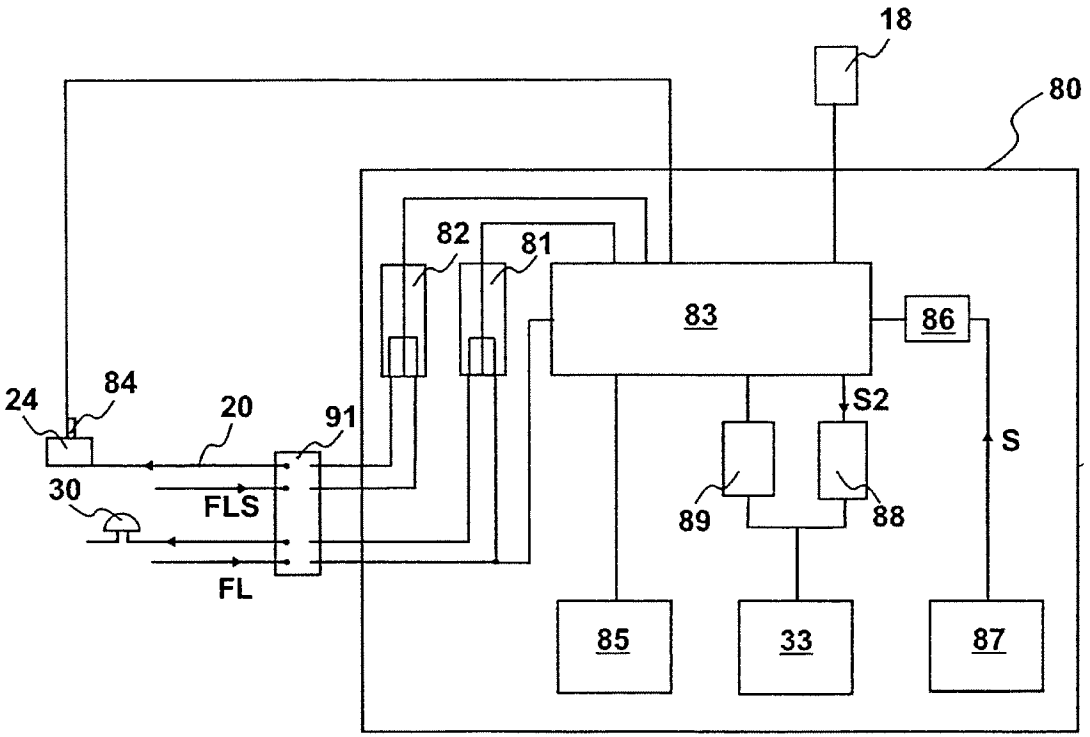
FIG. 3 shows a block diagram for connection of the safety device into safety switches of the work platform.
Figure 4:
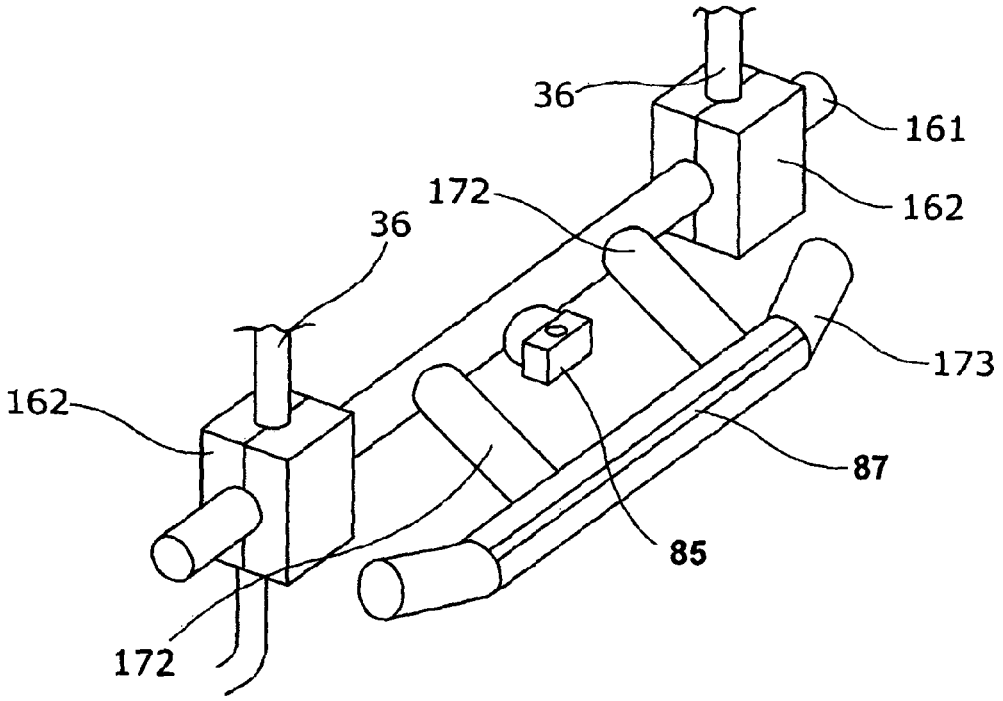
FIG. 4 shows an isometric view of a control panel with a pressure sensitive safety edge as the switch activation device.

With reference to FIG. 3 and FIG. 4, there is shown a safety device 80 and the preferred activation device comprising a pressure sensitive safety edge 87 mounted on a support bar 173 extending across the control panel 23, proximate to the controls. The support bar 173 is connected to a rigid mounting bar 161 by a pair of spaced apart supports 172. The mounting bar 161 is attached to the protection bars 36 by brackets 162. A reset button 85 for resetting the safety device 80 after activation is located behind the support bar 173.

A safety edge or safety bumper can be classified as a "trip" device. In general a safety edge or safety bumper is particularly suitable for use on machines which stop immediately after removal of power. A typical safety edge consists of an aluminium rail, a safety contact, and a safety contact strip. The special shape of the safety edge (rubber profile) protects the safety contact strip from damage. Safety bumpers operate in the same manner as safety edges, with the only constructional difference being the addition of foam rubber covered in polyurethane to protect any object that comes into contact with the safety bumper. A signal S from the safety edge 87 is passed to a control box 83.

With reference to FIG. 3, there is shown the present safety device 80 in which the power feed line FL to the emergency stop 30 is diverted to a connector 91 which serves to connect the safety device 80 into the controls 23. A second power feed line FLS to foot switch 24 is also diverted to the connector 91. The safety device 80 includes a pair of auxiliary safety switches, in the form of solenoid operated relays 81, 82, and the power feed FL to the emergency stop 30 is connected to one relay 81 and the power feed FLS to the foot switch 24 is connected to the other relay 82.

The two relays 81, 82 are connected to a control box 83 which can cause the relays 81, 82 to be closed, to allow electricity to flow to the emergency stop 30 and or the foot switch 24, or open, thereby cutting the flow of electricity to the controls 23.

The control box 83 includes a programmable processor and is connected to a switch activation device in the form of the safety edge 87. The signal S from the safety edge 87 passes to the control box 83 via a signal filter 86. The control box 83 is also connected to an alarm 33 via a pair of timers 88, 89 and to a reset device 85.

The alarm may be mounted on the underside 121 of the basket and may comprise a beacon and/or an audible warning device. The alarm may further include an RF transmitter which sends a radio signal to at least one further alarm remote from the basket and which includes a co-operating receiver which operates said alarms.

The control box 83 is supplied with power via the power input FL for the emergency stop 30. The control box 83 is connected to the foot switch 24 via a sensing line 84 to sense whether the foot switch 24 is up (not activated) or down (activated by the operator). The condition of the foot switch 24 may be determined by monitoring the potential at different locations within the foot switch 24. The control box 83 may also monitor overload signals from the load sensor 18 on the boom 14.

The relays 81, 82 are normally held in a closed condition, allowing power to pass through the relays 81, 82 to the emergency stop 30 and the foot switch 24. The control box 83 is programmed such that if the alarm 33 is in operation, the operation of the reset device 85 stops the alarm 33 and re-closes the relays 81, 82, which allows the controls 23 to again operate the lift.

When the power to MEWP 10 is first switched on after installation of the safety device 80, the safety device 80 is automatically activated via the feed FL. The control box 83 performs a self-diagnostic check for wiring problems. If the wiring check indicates a problem, either or both of the relays 81, 82 is opened preventing the operation of the MEWP 10 and the safety device 80 will not reset.

Further, the safety device 80 must then be checked so that if the safety edge 87 is compromised, that is subject to load, the safety device 80 will not reset.

When the controls 23 are subsequently switched on the control box 83 can go through the above-described checks and activate the safety device 80 without operation of the alarm 33.

The control box 83 is programmed to operate the alarm 33 only when the foot switch 24 is depressed by an operator and the safety edge 87 is compromised. When the foot switch 24 is raised and the basket 20 is parked, the control box 83 is programmed so that the safety device 80 is put into sleep mode and the alarm 33 is inactive. However, if the safety edge 87 is compromised at the time when the foot switch 24 is released, the alarm 33 will be operated. Further, if the load cell 18 senses an overload on the boom 14 at the time when the foot switch 24 is released, the alarm 33 will also be operated. The sleep mode helps prevent inadvertent operation of the alarm 33 when the operator has parked the platform to go about his normal work. If, when working at height, the operator accidentally pressures the safety edge 87, the alarm 33 will not operate. When the foot switch 24 is subsequently depressed, the safety device 80 is fully activated without operation of the alarm 33.

In the event that the safety edge 87 is triggered, a signal S is sent to the control box 83 via a signal filter 86. The signal filter 86 removes signal shorter than a pre-set time period, for example 0.6 seconds. If the signal S is greater than the pre-set time period, for example 0.6 seconds or longer, the control box 83 operates the two relays 81, 82 to open and cut power to the foot switch 24 and emergency stop 30 causing movement of the basket 20 to stop immediately. A signal S2 is also sent to the alarm 33 via the signal timer 88 to cause the alarm 33 to "pulse" for a second pre-determined time period, for example 10 seconds.

After the second pre-set time period, as measured by timer 88, the third timer 89 causes the alarm 33 to go into a continuous mode and keeps the controls 23 in an inactivate condition. The third timer 89 may operate a switch or relay in order to bring the alarm 33 into continuous mode. The controls 23 cannot then be operated until the pressure/load is removed from the safety edge 87 and the reset device 85 is activated.

The control box 83 may be connected to an override switch which permits the intermittent alarm pulse for the second pre-determined time period to be overridden with a continuous alarm, when the safety edge 87 is compromised. This is a beneficial feature when operating in high risk environments. The override switch may be returned to normal operation when working in less risky areas.

If the safety device 80 fails when the cage 20 is in the air, for example if either or both of the relays 81, 82 cannot operate, the alarm 33 is caused to operate to send out an alarm signal, and preferably to sound in a distinctive pattern such as SOS in Morse code. All other functions remain operative.

The safety device and the alarm are connected to the emergency switch means and the foot switch through readily connectable and disconnectable pin and socket connectors facilitating the assembly and disassembly of the safety device from the basket or cage of the aerial lift for testing, maintenance or replacement.

The invention claimed is:

1. A safety device, comprising:

a programmable control box;

an alarm operatively connected to said programmable control box;

a switch activation device operatively connected to said programmable control box and configured to be located proximate to controls of an aerial lift in which said controls are designed to permit an operator standing in a basket or cage of the aerial lift to manoeuvre said basket or cage of said aerial lift;

first and second solenoid operated relays operatively connected to said programmable control box, each of the first and second solenoid operated relays comprising a respective solenoid associated therewith, the first solenoid operated relay configured to be coupled to a manually operable emergency switch of said aerial lift in which said manually operable emergency switch is normally closed to allow a flow of electricity and operable to cut electrical supply and prevent further movement of the basket or cage;

the second solenoid operated relay configured to be operably coupled to a foot operable safety switch of said aerial lift in which said foot operable safety switch is operatively connected to said programmable control box and is required to be held closed by an operator to activate the controls, the solenoids holding each respective first and second solenoid operated relay in a closed condition unless caused to change to an open condition thereby cutting off said electrical supply, the first and second solenoid operated relays being controllable by said programmable control box; and a single sensing line directly connected between said programmable control box and said foot operable safety switch and wherein the control box is configured to cause the alarm to operate in accordance with a condition of the foot operable safety switch.

2. The safety device as claimed in claim 1, wherein the switch activation device is a pressure sensitive safety edge.

3. The safety device as claimed in claim 2, wherein the control box is configured to operate the alarm only when the foot operable safety switch is depressed by an operator and the pressure sensitive safety edge is compromised, and the alarm is configured not to be operated when the foot operable safety switch is raised and the basket or cage is parked.

4. The safety device as claimed in claim 3, wherein the control box is configured to operate a self-diagnostic routine when the aerial lift is first switched on and the foot operable safety switch raised to check if the safety device is correctly wired into the controls and that the safety device will not reset if compromised.

5. The safety device as claimed in claim 4, wherein the control box is configured to automatically activate the safety device provided that the self-diagnostic routine shows that the safety device is correctly wired and the safety device is reset.

6. The safety device as claimed in claim 1, further comprising a load sensor operably coupled to the control box, wherein the control box is configured to operate the alarm if the load sensor indicates an overload when the foot operable safety switch is raised.

7. The safety device as claimed in claim 2, wherein the control box is configured to operate the alarm if the pressure sensitive safety edge is compromised as the foot operable safety switch is raised.

8. The safety device as claimed in claim 1, further comprising a signal filter operatively connected to each of the control box and the alarm, the signal filter configured to pass a non-transitory signal to the alarm so that the alarm is operated after a predetermined period; and a timer is operatively connected to each of the control box and the alarm, the timer being configured to permit the alarm to operate intermittently for a pre-set time period.

9. The safety device as claimed in claim 8, wherein the control box is connected to a reset device which is configured to allow the alarm to be switched off within said pre-set time period provided that the switch activation device has ceased operation.

10. The safety device as claimed in claim 8, wherein the control box is also connected to the alarm via a second timer which is configured to cause the alarm to operate continuously after said pre-set time period.

11. An aerial lift, comprising:

a basket or cage;

controls designed to permit an operator standing in said basket or cage to manoeuvre said basket or cage;

a programmable control box;

a switch activation device operatively connected to said programmable control box and configured to be located proximate to said controls of the aerial lift;

first and second solenoid operated relays operatively connected to said programmable control box, each of the first and second solenoid operated relays comprising a respective solenoid associated therewith operatively connected to said programmable control box, the first solenoid operated relay configured to be coupled to a manually operable emergency switch of said aerial lift, said manually operable emergency switch being normally closed to allow a flow of electricity and operable to cut electrical supply and prevent further movement of the basket or cage;

the second solenoid operated relay configured to be operably coupled to a foot operable safety switch of said aerial lift, said foot operable safety switch being operatively connected to said programmable control box and being required to be held closed by an operator to activate the controls, the solenoids holding each respective first and second solenoid operated relay in a closed condition unless caused to change to an open condition thereby cutting off said electrical supply, the first and second solenoid operated relays being controllable by said programmable control box; and a single sensing line directly connected between said programmable control box and said foot operable safety switch and wherein the control box is configured to cause an alarm to operate in accordance with a condition of the foot operable safety switch.

12. The aerial lift as claimed in claim 11, wherein the alarm is mounted on an underside of the basket or cage.

13. The aerial lift as claimed in claim 11, wherein the alarm comprises at least one selected from the group consisting of: a beacon and an audible warning device.

* * * * *